US008893814B2

(12) United States Patent
Bui

(10) Patent No.: US 8,893,814 B2
(45) Date of Patent: Nov. 25, 2014

(54) ROOF TOP AND ATTIC VENT WATER MISTING SYSTEM

(71) Applicant: My Bui, San Diego, CA (US)

(72) Inventor: My Bui, San Diego, CA (US)

( * ) Notice: Subject to any disclaimer, the term of this patent is extended or adjusted under 35 U.S.C. 154(b) by 31 days.

(21) Appl. No.: 13/626,102

(22) Filed: Sep. 25, 2012

(65) Prior Publication Data

US 2013/0020098 A1 Jan. 24, 2013

Related U.S. Application Data

(63) Continuation-in-part of application No. 12/498,327, filed on Jul. 6, 2009, now Pat. No. 8,276,679.

(51) Int. Cl.

| | |
|---|---|
| ***A62C 35/68*** | (2006.01) |
| ***A62C 35/15*** | (2006.01) |
| ***A62C 35/00*** | (2006.01) |
| ***A62C 2/00*** | (2006.01) |
| ***A62C 3/00*** | (2006.01) |
| ***E04D 13/00*** | (2006.01) |
| ***A62C 3/02*** | (2006.01) |
| ***A62C 99/00*** | (2010.01) |

(52) U.S. Cl.

CPC ..... *E04D 13/00* (2013.01); *A62C 3/0214* (2013.01); *A62C 99/0072* (2013.01); *Y10S 239/15* (2013.01)

USPC ..... 169/45; 169/9; 169/16; 239/208; 239/373; 239/DIG. 15

(58) Field of Classification Search

USPC ..... 169/5, 9, 13, 16, 45; 239/208, 209, 373, 239/450, DIG. 15

See application file for complete search history.

(56) References Cited

U.S. PATENT DOCUMENTS

| | | | | |
|---|---|---|---|---|
| 4,330,040 | A | 5/1982 | Ence et al. | |
| 4,428,434 | A * | 1/1984 | Gelaude | 169/13 |
| 5,125,458 | A | 6/1992 | Berman et al. | |
| 5,165,482 | A * | 11/1992 | Smagac et al. | 169/45 |
| 5,727,350 | A | 3/1998 | Marcella | |
| 5,931,233 | A * | 8/1999 | La Bonte et al. | 169/5 |
| 6,009,954 | A | 1/2000 | Phillips | |
| 6,189,805 | B1 | 2/2001 | West et al. | |
| 6,523,616 | B1 | 2/2003 | Wallace | |
| 7,137,269 | B1 | 11/2006 | Maranville | |
| 7,234,653 | B2 | 6/2007 | Powell et al. | |
| 7,334,744 | B1 | 2/2008 | Dawson | |
| 7,886,837 | B1 * | 2/2011 | Helfgott | 169/54 |
| 2005/0183866 | A1 * | 8/2005 | Gilson | 169/16 |
| 2008/0000649 | A1 | 1/2008 | Guirguis et al. | |

* cited by examiner

*Primary Examiner* — Darren W Gorman

(74) *Attorney, Agent, or Firm* — MDIP LLC

(57) ABSTRACT

The present invention describes systems and methods which provide a moisture barrier that douses or diffuses buoyant burning debris, particularly hot embers, from a bush and/or brush fire (e.g., wildfires). By strategic placement of the devices and/or apparatus as disclosed, a method of preventing the destruction of dwellings and roof-containing structures by exploiting heat convection is provided.

20 Claims, 15 Drawing Sheets

ROOF TOP AND ATTIC VENT WATER MISTING SYSTEM

CROSS REFERENCE TO RELATED APPLICATION

This is a continuation-in-part application of U.S. application Ser. No. 12/498,327, filed Jul. 6, 2009, now U.S. Pat. No. 8,276,679.

BACKGROUND OF THE INVENTION

1. Field of the Invention

The present invention relates generally to fire prevention, and specifically to devices and methods for preventing the destruction of dwellings and other roof-containing structures from fires caused primarily from burning debris, especially embers from brush/bush fires, by co-segregation of atomized fluids and buoyant burning debris using perimeter fluid delivery and heat convection.

2. Background Information

Each year, the cycles of little rain followed by a long dry spell have lead to the accumulation of large amounts of dry brush and other vegetative combustibles. Under such conditions, dried trees and bushes become ideal fuel for wildfires. In regions with perennial dry seasons, these conditions produce fires that cause billions of dollars worth of damage.

With wildfires in the West seemingly becoming more frequent and destructive, there is a growing concern that climate change associated with global warming might be creating more fertile environments for these fires. In California, a major concern is centered on the effects of the Santa Ana winds. The Santa Ana winds are strong, extremely dry offshore winds that characteristically sweep through in Southern California and northern Baja California. They can range from hot to cold, depending on the prevailing temperatures in the Great Basin and upper Mojave Desert. However, the winds are noted most for the hot dry weather that they bring in autumn With extremely low to no humidity and high temperatures, all that is necessary is a spark, and with the strong winds fanning the flames, in no time there is a full scale wildfire.

There is a widely held belief that fast moving wildfires explode houses into flames, burning them down in minutes, however, this not borne out by scientific observation. Typically, the majority of houses destroyed in wildfires actually survive the passage of the fire front, only to burn down from ignitions caused by buoyant burning debris. In fact, showers of burning debris may attack a building for some time before the fire front arrives, during the passage of the fire front and for several hours after the fire front has passed. This long duration of attack, to a large extent, explains why burning debris is a major cause of ignition of roof-containing structures.

Further, video footage of burning buildings caused by wildfires shows that a fire usually starts from the roofs and attics, then propagates downward to the support, and then collapses onto the lower section of the structure. The most common culprits for the observed vulnerability of roofed-structures are interstices between tiles and/or shingles and the openings for ventilation. These interstices and openings provide an entry path for flying embers to ignite structural items that make up the roof (i.e., plywood panels, support tresses, and felt liners), as well as fuels available in attics (e.g., old papers, clothing and the like).

While systems exist claiming to prevent fires on roof-containing structures, they all must be placed on or over the top or apex of the roof, and/or use copious amounts of water (see, e.g., U.S. Pat. Nos. 4,330,040; 5,263,543; 5,692,571; 6,679,337). What is needed is a system that douses embers as they enter interstices and openings available on roofs, which embers escape systems that provide water only in a downward direction along the slope of the roof via gravity.

In addition, during an emergency, the water supply and its pressure are often reduced, and without water and appropriate pressure, a misting system may be rendered useless. Thus, a system that may compensate for changes in water supply and pressure is also needed.

The present invention fulfills these needs.

SUMMARY OF THE INVENTION

The present invention describes devices and methods for preventing the destruction of dwellings and other roof-containing structures from fires caused primarily from burning debris, especially embers from brush/bush fires, including a system for automation of filling of water tanks, pressurizing the tanks and alternating discharge of water from the tanks to maintain a reliable water supply and pressure to a misting system.

In one embodiment, a system for protecting a roof-containing structure from fire embers is disclosed including at least two fluid containers comprising a first, second, third and fourth aperture, and a water level float sensor suspended from a surface within the at least two fluid containers, which third aperture is coupled to a pressure relief valve, and which fourth aperture is connected to a first lumen-containing conveyance configured to be in one-way fluid communication with a water supply separate from the at least two fluid containers via a check valve; a first device connected to each fluid container through the first aperture that discontinuously increases the pressure of a gas above a fluid in the at least two fluid containers by providing air flow into the at least two fluid containers, where the first device is connected to the first aperture via a second lumen-containing conveyance connected to a first T-fitting connector, which first T-fitting connector is connected to an air venting valve; at least one third lumen-containing conveyance where one end is connected to each at least two fluid containers at the second aperture, where the each at least one third lumen-containing conveyance is configured to be in one-way fluid communication with the at least two fluid containers via a check valve, which each at least one third lumen containing conveyance is connected at a second end to a second T-fitting connector; at least one fourth lumen-containing conveyance connected at one end to the second T-fitting connector, where the fourth lumen-containing conveyance includes i) at least one pressure sensor proximal to the second T-fitting connector and ii) one or more nodal points along the at least one fourth lumen-containing conveyance distal to the at least two fluid containers which comprises a second device at the one or more nodal points, where the second device comprises one or more atomizing orifices; and a controller module in electromechanical communication with the first device, the pressure sensor, the air venting valve, and the water level float sensor, where the at least one fourth conveyance is releasably coupled to an outer surface of the roof-containing structure such that an atomized fluid delivered by the at least one fourth lumen-containing conveyance and buoyant fire embers co-segregate via heat convection.

In one aspect, the controller module communicates with the first device, the pressure sensor, the air venting valve, and the water level float sensor wirelessly. In a related aspect, the water supply is connected to the first lumen-containing conveyance via a third T-fitting connector and a fifth lumen-containing conveyance, which the fifth lumen-containing conveyance is directly connected to at least one source of water. In a further related aspect, one source of water is pressurized. In another related aspect, the system further includes a third device in fluid communication with the fifth lumen-containing conveyance that discontinuously moves water into the fifth lumen-containing conveyance, where the third device is submerged in a source of water which is not pressurized or is at ambient pressure.

In another related aspect, the source of water which is not pressurized or is at ambient pressure includes swimming pools, ponds, streams, lakes, rivers, tributaries, fountains, wells, reservoirs, oceans, seas, and combinations thereof.

In one aspect, the pressurized water is from a municipal source. In another aspect, the first device is an air-compressor. In one aspect, the air venting valve is an electrical latching solenoid valve. In another aspect, the check valves comprise passive, spring loaded shutters.

In one aspect, the third device is a pump. In another aspect, the at least one fourth lumen-containing conveyance is releasably coupled to the outer surface:

i) along one or more gutters at the periphery of the roof-containing structure;

ii) at one or more vents projecting from an upper surface of the roof-containing structure;

iii) along one or more valleys of the roof-containing structure; or iv) a combination of (i), (ii), and (iii).

In another embodiment, an apparatus for protecting a roof-containing structure from fire embers is disclosed including at least two fluid containers comprising a first, second, third and fourth aperture, and a water level float sensor suspended from a surface within the at least two fluid containers, which third aperture is coupled to a pressure relief valve, and which fourth aperture is connected to a first lumen-containing conveyance configured to be in one-way fluid communication with a water supply separate from the at least two fluid containers via a check valve; a first device connected to each fluid container through the first aperture that discontinuously increases the pressure of a gas above a fluid in the at least two containers by providing air flow into the at least two fluid containers, where the first device is connected to the first aperture via a second lumen-containing conveyance connected to a first T-fitting connector, which first T-fitting connector is connected to an air venting valve; at least one third lumen-containing conveyance where one end is connected to each at least two fluid containers at the second aperture, where the each at least one third lumen-containing conveyance is configured to be in one-way fluid communication with the at least two fluid containers via a check valve, which each at least one third lumen containing conveyance is connected at a second end to a second T-fitting connector; at least one fourth lumen-containing conveyance connected at one end to the second T-fitting connector, where the fourth lumen-containing conveyance includes i) at least one pressure sensor proximal to the second T-fitting connector and ii) one or more nodal points along the at least one fourth lumen-containing conveyance distal to the at least two fluid containers which comprises a second device at the one or more nodal points, where the second device comprises one or more atomizing orifices; and a controller module in electro-mechanical communication with the first device, the pressure sensor, the air venting valve, and the water level float sensor.

In another embodiment, a method of maintaining pressure of a misting system as disclosed includes filling the at least two fluid containers with a liquid at a system water pressure of between about 50 to about 60 psi, where the air venting valve in each of the at least two fluid containers is open; closing the air venting valve in each of the at least two fluid containers when the liquid reaches the top of the at least two fluid containers via the communication between the water level sensor float and the controller module; detecting a drop in water inlet pressure via pressure sensor, where the first device is turned ON in one of the at least two fluid containers when the pressure sensor detects a system water pressure between about 0 psi and about 25 psi via communication between the pressure sensor and the controller module; turning the first device OFF in the one of the at least two fluid containers at a first set period of time; turning the first device ON in another one of the at least two fluid containers after the first period of time, where the air venting valve for the one of the at least two fluid containers is opened via the communication between the air venting valve in the one of the at least two fluid containers and the controller module, and where the air venting valve of the another one of the at least two fluid containers is closed via communication between the air venting valve in the another one of the at least two fluid containers and the controller module; turning the first device OFF in the another one of the at least two fluid containers at a second set period of time; turning the first device ON in the one of the at least two fluid containers after the second set period of time, where the air venting valve for the another one of the at least two fluid containers is opened via the communication between the air venting valve in the another one of the at least two fluid containers and the controller module, and where the air venting valve of the one of the at least two fluid containers is closed via communication between the air venting valve in the one of the at least two fluid containers and the controller module; and repeating steps the above until the system water pressure reaches a pressure greater than about 25 psi.

In one aspect, system water pressure and liquid release rate are such that the liquid is released over a period from about 0.5 to 8 hours. In another aspect, the liquid includes water; water and cellulose; water and ammonia; water, camphor, and ammonium chloride; hydroxyl ammonium nitrate; an amine nitrate salt; and combinations thereof.

BRIEF DESCRIPTION OF THE DRAWINGS

Exemplary embodiments of the present invention will hereinafter be described in conjunction with the appended drawing figures, wherein like numerals denote like elements.

DETAILED DESCRIPTION OF THE INVENTION

Before the present composition, methods, and methodologies are described, it is to be understood that this invention is not limited to particular components, methods, and apparatus described, as such components, methods, and apparatus may vary. It is also to be understood that the terminology used herein is for purposes of describing particular embodiments only, and is not intended to be limiting, since the scope of the present invention will be limited only in the appended claims.

As used in this specification and the appended claims, the singular forms "a", "an", and "the" include plural references unless the context clearly dictates otherwise. Thus, for example, references to "a valve" includes one or more valves, and/or components of the type described herein which will become apparent to those persons skilled in the art upon reading this disclosure and so forth.

Unless defined otherwise, all technical and scientific terms used herein have the same meaning as commonly understood by one of ordinary skill in the art to which this invention belongs. Any methods and materials similar or equivalent to those described herein can be used in the practice or testing of the invention, as it will be understood that modifications and variations are encompassed within the spirit and scope of the instant disclosure.

As used herein, "atomization," including grammatical variations thereof, means the conversion of a liquid into a spray of very fine droplets.

As used herein, "co-segregate," including grammatical variations thereof, means to migrate or move coordinately so as to separate or sequester jointly. For example, the fine droplets produced by atomization co-segregate with buoyant embers such that the embers are no longer available for combustion.

As used herein, "system water pressure" refers to the amount of force applied uniformly within the cavities of components which make up the apparatus as disclosed (e.g., lumen containing conveyances).

As used herein, "inlet water pressure" refers to the amount of force exhibited by the water supply coming from without the components which make up the apparatus as disclosed (e.g., from a municipal spigot or non-pressurized water source).

Figure 1:
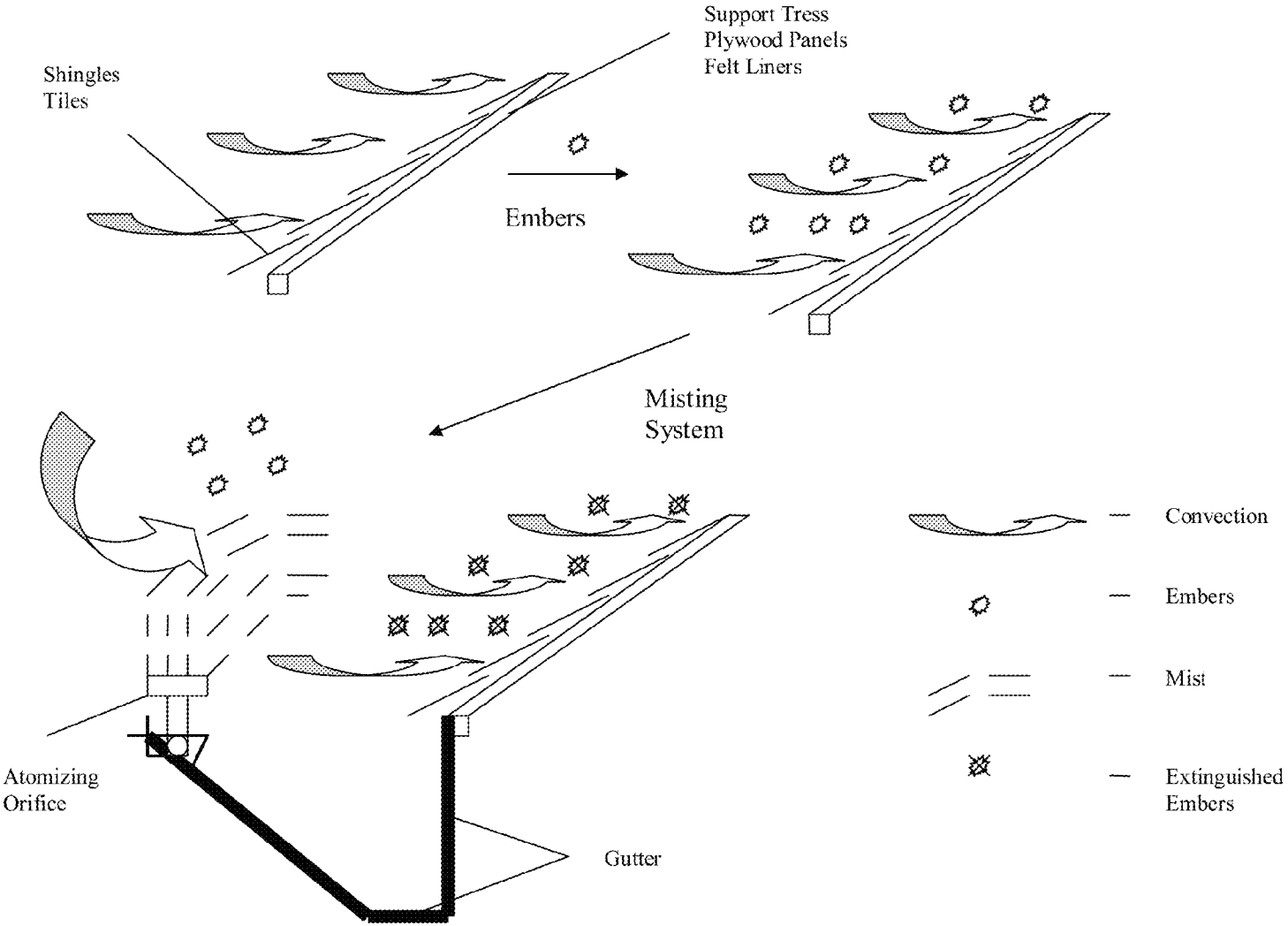
FIG. 1 illustrates how an atomized fluid carried by heat convection extinguishes buoyant embers.

With reference to the accompanying Figures, the present invention generally relates to devices and methods for preventing the destruction of dwellings and other roof-containing structures from fires caused primarily from burning debris, especially embers from brush/bush fires. FIG. 1 illustrates that embers that become buoyant by convection land within interstices present on the roof, thus they are capable of igniting materials contained therein (e.g., wood making up the support tresses, plywood panels, felt liners and the like). The system and apparatus of the present invention produce atomized droplets of fluid which float with the embers and are thus deposited with them as a function of heat convection, thereby preventing ignition of combustible materials by extinguishing the embers prior to, concomitant with, and/or subsequent to contact with such interstices.

Figure 2:
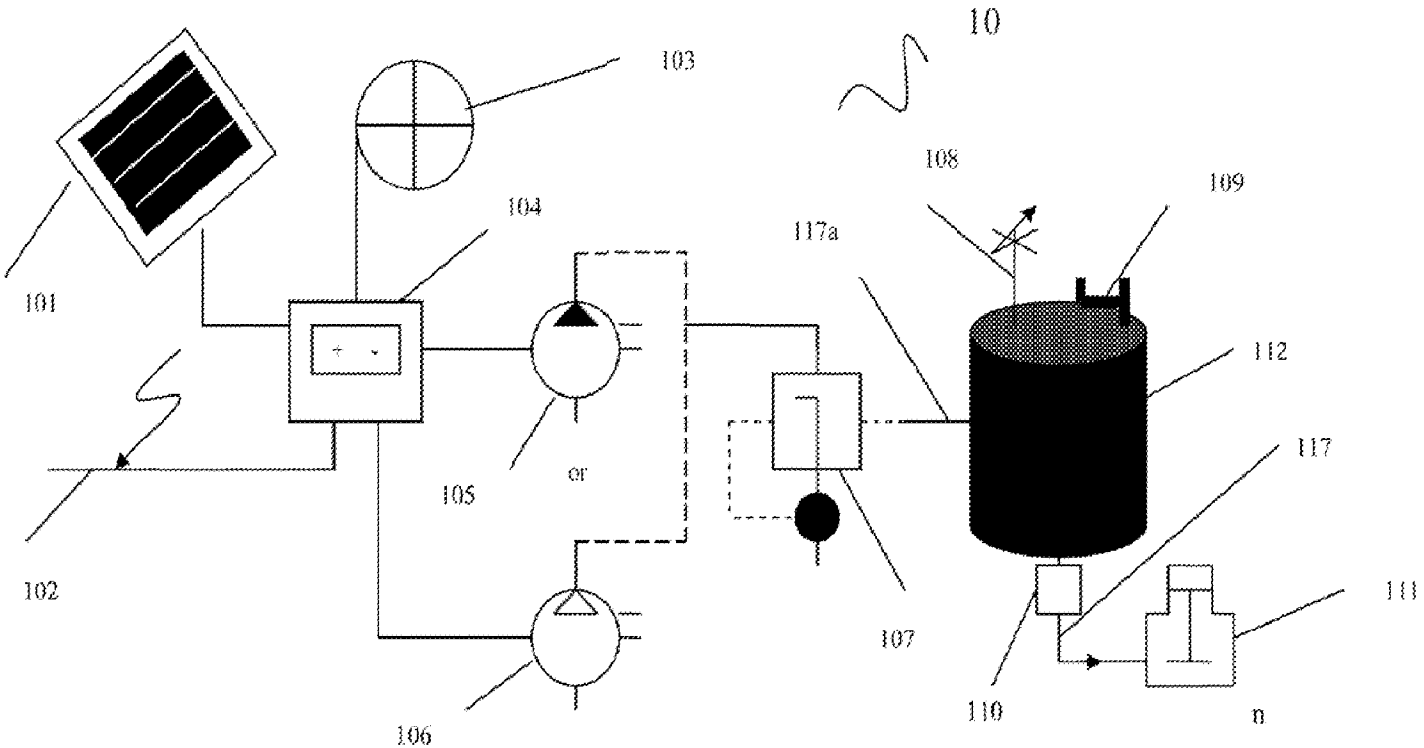
FIG. 2 shows the components of the present invention as described.

FIG. 2 illustrates a system 10 for protecting a roof-containing structure from fire embers. In FIG. 2, the fluid container 112 comprises at least two apertures for ingress 117*a* and egress 117 of fluids. Further, the container 112 is pressurizable, and may be portable or stationary, depending on the amount of fluid to be contained therein. In one aspect, the container 112 may accommodate about 10 to 20 gallons of liquid, about 20 to 50 gallons of liquid, about 50 to 75 gallons of liquid, or greater than about 100 gallons of liquid. In a related aspect, the container 112 contains at least 50 gallons of water.

The container 112 may be made of plastic or metal and/or any other material that allows for containment of multiple gallons of a fluid with at least the density of water, and that allows for pressurization of at least 60 psi. In one embodiment, the fluid comprises water, however, any atomizable fire-suppressant fluid may be used in the present invention. For example, fluids may be water or water-based mixtures, including but not limited to cellulose, water and ammonia; water, camphor, and ammonium chloride; hydroxyl ammonium nitrate, an amine nitrate salt, and water and the like.

The container 112 may contain one or more additional apertures to accommodate a pressure relief valve 108 and/or an additional water inlet 109. The container 112 is configured to be communication with a first device 105 or 106 that discontinuously increases the pressure of a gas above a liquid or other fluid by displacing (pump 105) or reducing (compressor 106) gas volume. The first device 105/106 is controlled by a passive feedback control loop via fluid communication with a pressure regulator 107 between the first device 105/106 and the container 112. The first device 105/106 may be an electrically or mechanically automated machine which provides discontinuous, intermittent airflow into the fluid container 112 via a pressure regulator 107 in a passive feedback-control loop configuration. This regulator 107 operates the system in a highly efficient manner, since the loop configuration does not require continuous power consumption by the first device 105/106 for pressure modulation control in the container 112 after the system 10 is activated. For example, when the egress pressure from the container 112 reaches a specific value (e.g., 24 psi) the feedback loop shuts off the first device 105/106, and when the egress pressure from the container 112 goes below 24 psi, the first device 105/106 is activated.

In embodiments, the first device 105/106 is electrically automated. In one aspect, the fluid is delivered under a pressure of about 15 to 18 psi, about 18 to 20 psi, about 20 to 22 psi, or about 22 to 24 psi. In another aspect, the fluid is delivered under a pressure of about 18 to 24 psi.

The embodiment shown in FIG. 2 also includes a rechargeable battery 104 which is configured to be in electrical communication with an AC/DC power source 102 (e.g., but not limited to, a wall outlet or a generator), a solar source 101, or wind turbine 103 or a combination thereof.

The container 112 is also coupled to a lumen containing conveyance 117 (e.g., a hose, pipe or other fluid transfer conduit for directing the flow of liquids) which may comprise plastic, rubber, cloth, metal, fire resistant material or a combination thereof. Such a conveyance may comprise a valve 110 (manual or automatic) for regulating liquid egress from the container 112. Further, the conveyance 117 contains a plurality of nodal points (n) along its length, where such nodal points contain a second device 111. The second device 111 transforms the incoming pressure to a higher second pressure such that a liquid delivered by the conveyance 117 is converted into a spray of very fine droplets (i.e., an atomizing orifice; for example, but not limited to, a nozzle or mister). In one aspect, such a second device 111 has a fluid release rate of about 0.0083 to 0.0090 gallons per minute (GPM), about 0.0090 to 0.0100 GPM, about 0.0100 to 0.0150 GPM, about 0.0150 to 0.020 GPM, and from about 0.020 to 0.024 GPM. In another aspect, the fluid release rate is about 0.0084 to 0.023 GPM. The conveyance 117 may be of any length, and may contain lengths devoid of nodal points (n) to allow for distal placement of the second device 111.

The system 10 may also comprise gauges and additional valves to monitor and effect fluid flow. In one aspect, the system 10 is activated manually prior to leaving a home or other roof-containing structure once a wildfire emergency has been declared. In another aspect, the system 10 may be activated remotely if a user is notified away from a dwelling or other roof-containing structure that such an emergency exists. Further, automatic activation may be actuated by smoke detection, fire detection, or other external-environment based detection systems.

Figure 3:
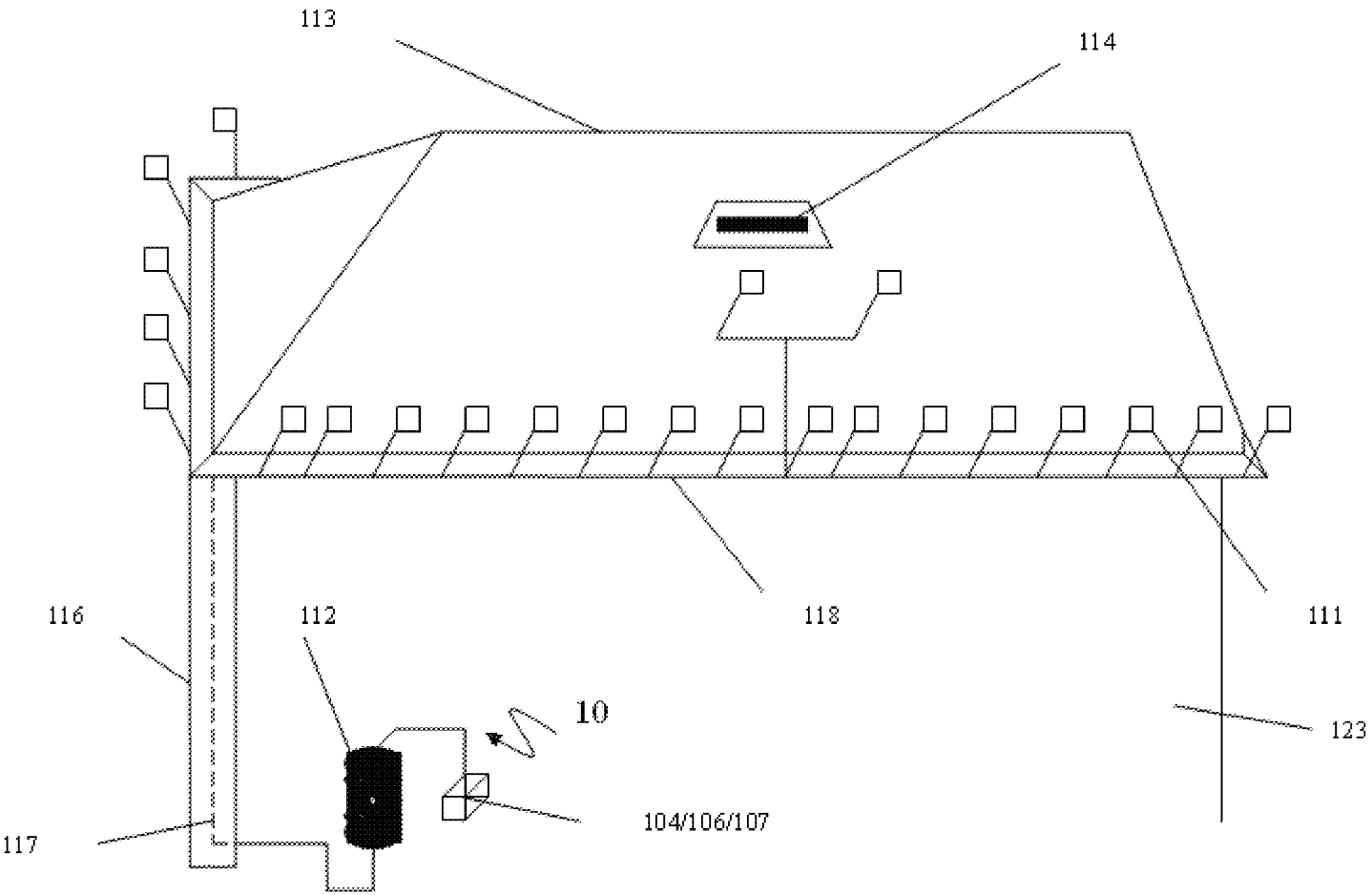
FIG. 3 shows an embodiment of the present invention positioned on the roof of a dwelling as disclosed.

FIG. 3 shows the system 10 where the orifices 111 are strategically placed on the roof 113 and at a vent 114 of a dwelling by running the conveyance 117 up a downspout 116 and along the gutters 118 of the dwelling (e.g., at the bottom of the roof-line or at the drip edge). In this embodiment, such placement maximizes the exploitation of air flow produced by heat to drive a misting fluid with any buoyant embers along the face of the roof 113. Thus, the positioning as illustrated achieves the co-segregation of the atomized fluid with buoyant embers such that the embers are no longer available for combustion. Such exploitation is not possible where release of the liquid is only from the top or apex of the roof 113 (i.e., heat convection would blow released fluids away from the structure). In one aspect, the orifices 111 are strategically placed such that they face a wind moving from east to west. In another aspect, the orifices 111 may be coupled to servos or other mechanical devices such that the orifices 111 may be repositioned automatically/remotely to take advantage of wind direction.

The embodiment of FIG. 3 also illustrates the placement of the orifices 111 in front of any vents 114 which project from the surface of the roof 113 for protection against embers potentially entering the attic.

Figure 4:
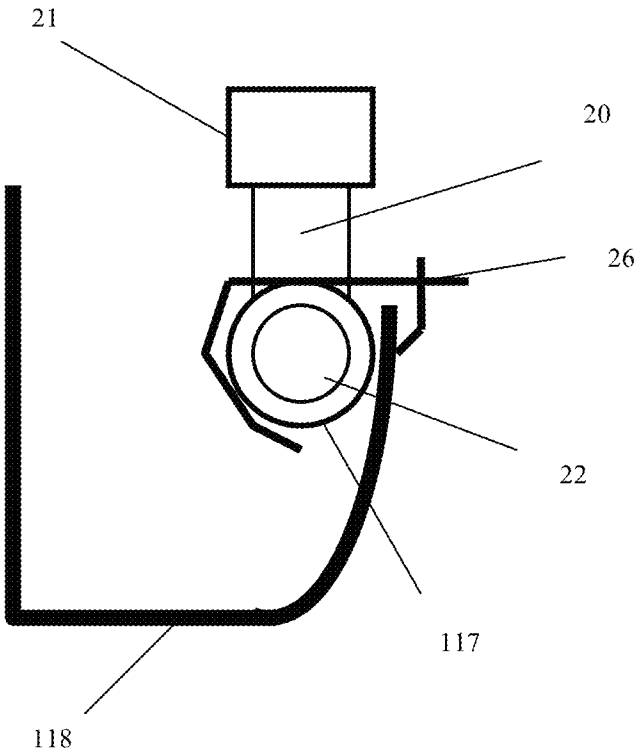
FIG. 4 shows an atomizing orifice of the present invention, including a preferred embodiment as disclosed.
Figure 4:
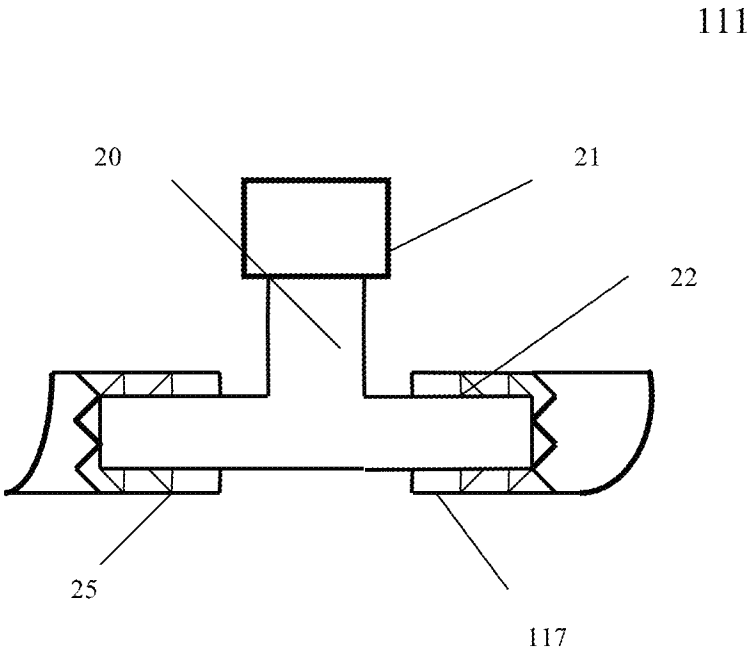

FIG. 4 shows a detailed illustration of an atomizing orifice 111. As seen in the figure, the orifice has three main components; a nozzle head 21, a first conduit 20 perpendicular to the flow line of the conveyance 117 and a second conduit 22 integral with the perpendicular conduit and that is parallel with the flow line of the conveyance 117. As the system 10 is closed and under pressure, fluid can only escape through the orifices 111.

The nozzle head 21 may be made from any material, including but not limited to, metal, plastic, rubber or a combination thereof. Such nozzles are commercially available (see, e.g., Ecologic Technologies, Pasadena, Md.), and come in a wide variety of colors, angles and GPM rates. In one aspect, the angle of the orifice is about 115° or about 180°.

The first perpendicular conduit 20 may be of any length, such that nozzle 21 height provides a sufficient atomized liquid canopy for co-segregation via heat convection. The integral second parallel conduit 22 also contains protuberances 25 on its outer surface which produce an air-tight/water-tight seal against the inner lumen of the conveyance 117. FIG. 4 also shows an orifice 111 attached to a gutter 118 via a releasable mechanism 26 (e.g., including, but not limited to a clip).

Figure 5:
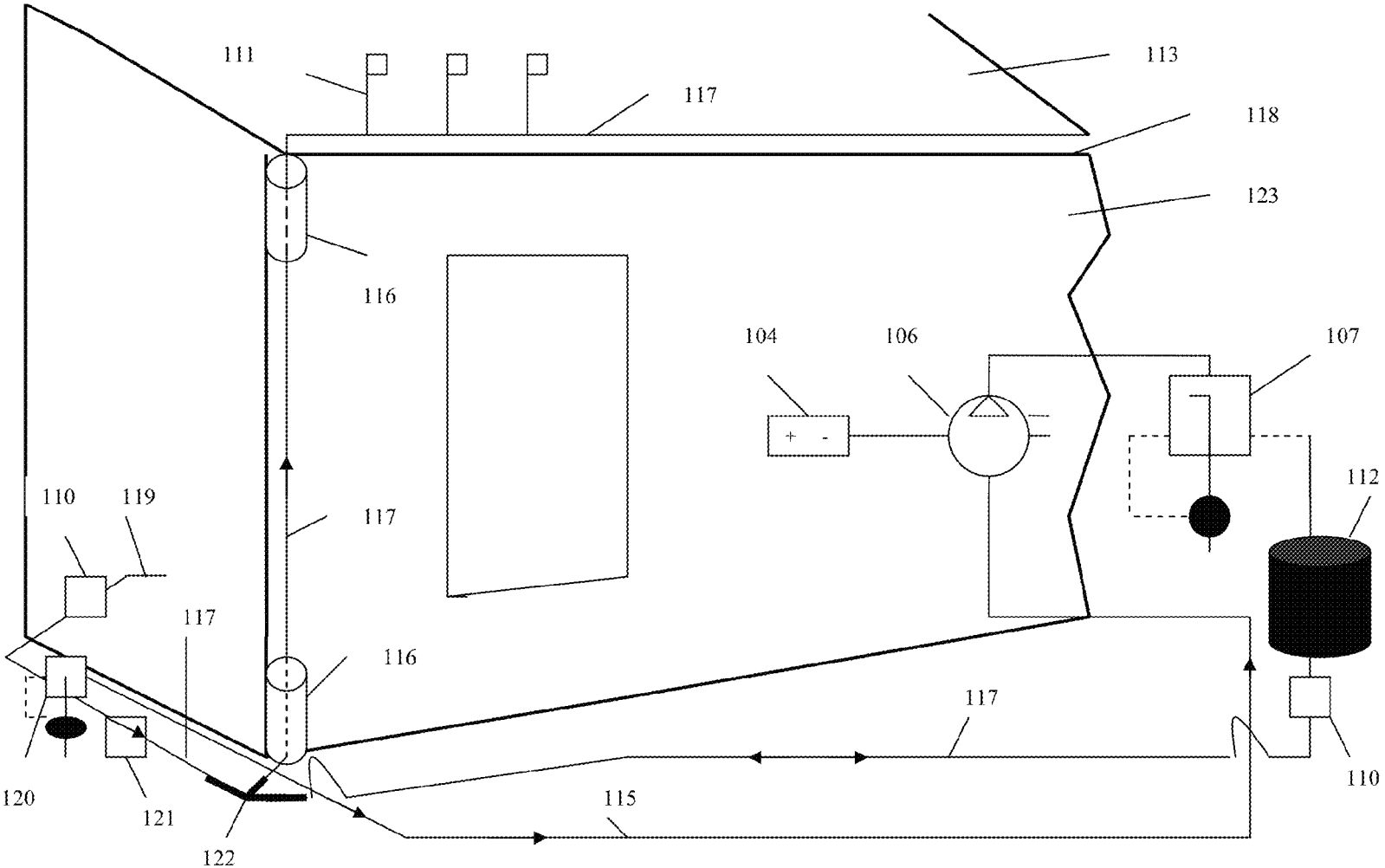
FIG. 5 shows another embodiment of the present invention positioned on the roof of a dwelling as disclosed.

FIG. 5 shows an embodiment of the present invention comprising more than one source of fire suppressant (e.g., water or fire retardant liquid). In this embodiment, water, for example, may be obtained from either the container 112 or from a municipal/household source 119. Fluid flow from the container 112 and municipal source 119 may be effected by manual control valves 110; however, when the system 10 is under automated control, separate systems become active (110 valves would remain open). Under automated control, flow from the municipal source 119 is controlled by an actuator 120 (which is in fluid communication with the municipal source 119 and in electrical communication with the first device 106) and a check valve 121 to ensure one way fluid communication from the municipal source 119. The conveyance 117 from the municipal source 119 is in fluid communication with a T-fitting connector 122 (although a T-fitting connector is described, one of skill in the art would understand that any connector comprising at least three flow paths will be useful for the present embodiment as disclosed). When, for example, water pressure is low from this source 119 (e.g., over use of municipal source during wildfire), the actuator will shut-off flow from the municipal source 119 and engage flow from the container 112 via activation of the first device 106 (e.g., when pressure from 119 is less than 25 psi), as the actuator 120 is in electrical communication with the first device 106 through an electrical conduit 115. Flow from the container 112 is the same as described above, except that the conveyance 117 is coupled to the common T-fitting connector 122. If the container 112 is emptied, and municipal flow 119 is available, the first device 106 will shut-off, and the actuator 120 will engage flow from the municipal source 119, including reversing flow through the conveyance 117 to fill the container using the municipal source 119 (e.g., when pressure from municipal source 119 is greater than 40 psi).

Figure 6:
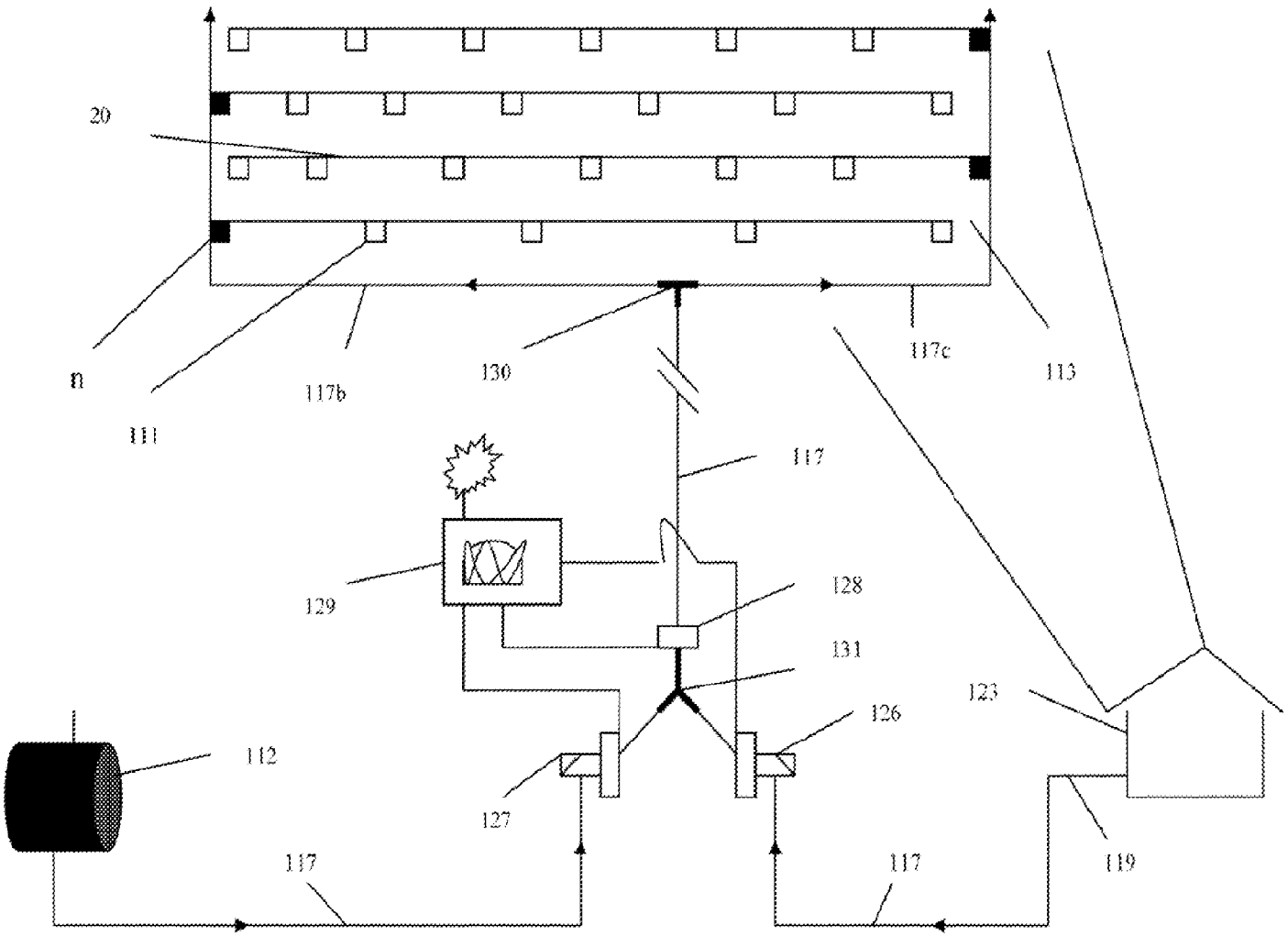
FIG. 6 shows a variation of the embodiment of the invention as illustrated in FIG. 5.

FIG. 6 illustrates a variation of the separate source embodiment of FIG. 5. In this embodiment, the fluid flow from the two sources (112, 119) is controlled by a pressure sensor 128, a first 126 and second 127 solenoid, and a control module 129 which may be monitored and managed telemetrically. Under automated control and after the system is activated, the control module 129 acquires data from the pressure sensor 128 and relays that data to a user. If the pressure changes for one fluid source or the other, the user may then switch sources by manipulating the solenoids 126, 127 remotely. As shown in the figure, the pressure sensor 128 and solenoids 126, 127 are in fluid communication via a tripartite valve 131 (again, one of skill in the art would understand that any connector comprising at least three flow paths will be useful for the present embodiment as disclosed), and are in electrical communication with the control module 129. Also shown is a positioning of the nodal containing conveyance 117 in a parallel lattice formation along the face of a roof 113. To achieve the lattice, the conveyance 117 is split into two flow paths (117*b*, 117*c*) via a T-fitting connector 130, and is then configured to go along the roof surface 113 in parallel. The orifices 111 are contained on long first perpendicular conduits 20 and interdigitate as they project from opposite nodal points (n). Alternatively, perpendicular conveyances 117 containing a plurality of nodal points (n) comprising multiple orifices 111 in fluid communication via multiple T-fitting connectors 130 may be used. This pattern may be useful when greater coverage on larger roof surfaces is required (e.g., a warehouse or mansion).

Figure 7:
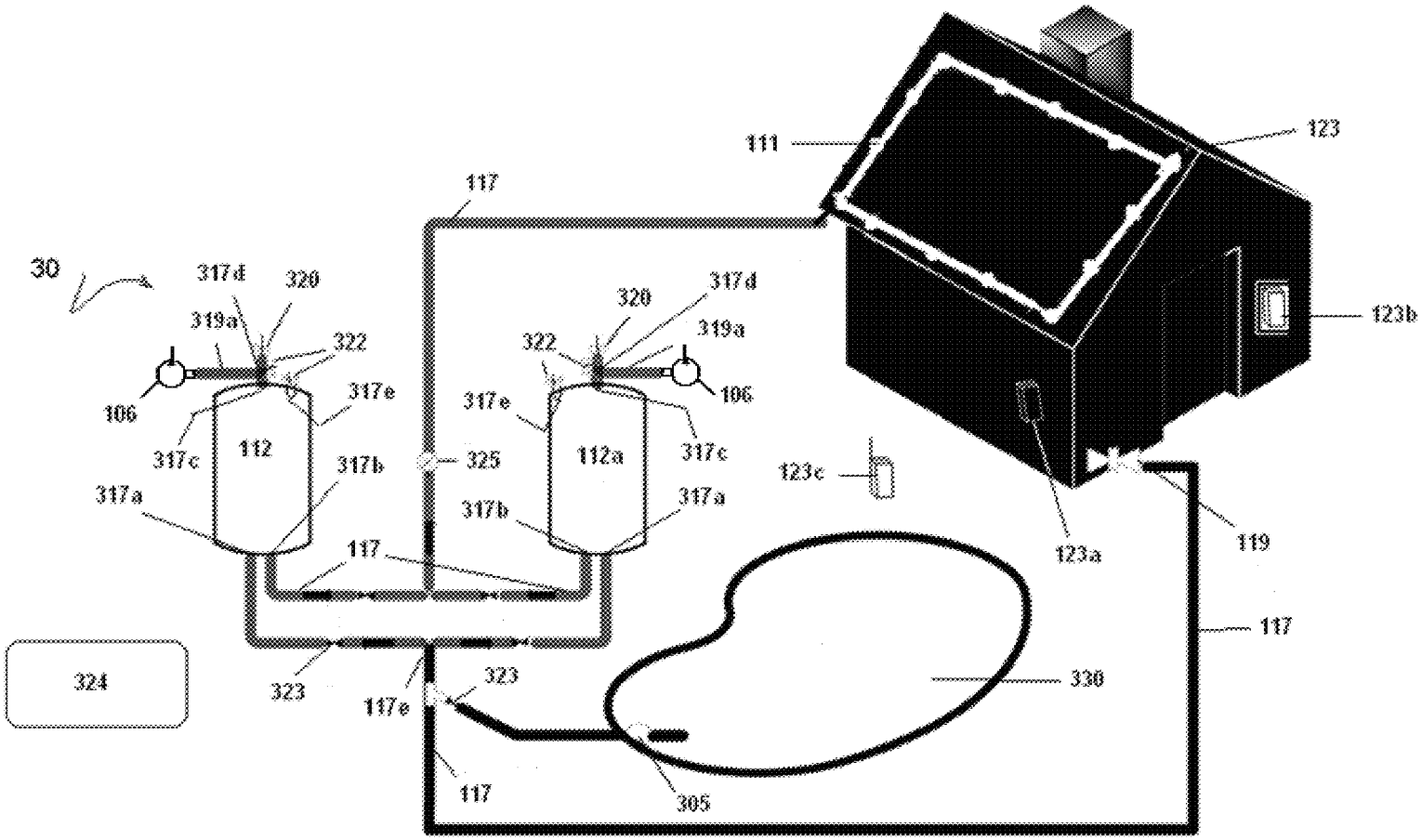
FIG. 7 shows a misting system installed on a roof top of a house and an alternate water source supplied by a swimming pool or other body of water external to public water supply.

Referring to FIGS. 7-15, for the dual tank system 30, the Tanks A 112 and B 112*a* may be of about 20 to 30 gallon capacity, made of plastic (e.g., lightweight fiberglass wrapped tanks) or metal, combinations thereof, and/or any other material that allows for containment of multiple gallons of a fluid with at least the density of water, and that allows for pressurization of at least 85 psi. In embodiments, the fluid comprises water, however, any atomizable fire-suppressant fluid may be used in the present invention. For example, fluids may be water or water-based mixtures, including but not limited to cellulose; water and ammonia; water, camphor, and ammonium chloride; hydroxyl ammonium nitrate; an amine nitrate salt and water; and the like. A typical roof containing structure 123 will have the misters 111 installed on the roof. The dual tank system 30 in FIG. 7 illustrates the optional water source which may be a pool 330. As illustrated in FIGS. 7-15, a first lumen containing conveyance 117*e* may be connected to said optional water source 330/119 via a check valve 323, where one end of said first lumen containing conveyance 117*e* is connected to a T-fitting connector 130, which connector 130 in combination with a separate check valve 323 allows for directional flow of water away from said optional water source 330/119 to Tanks A 112 and B 112*a*.

Figure 8:
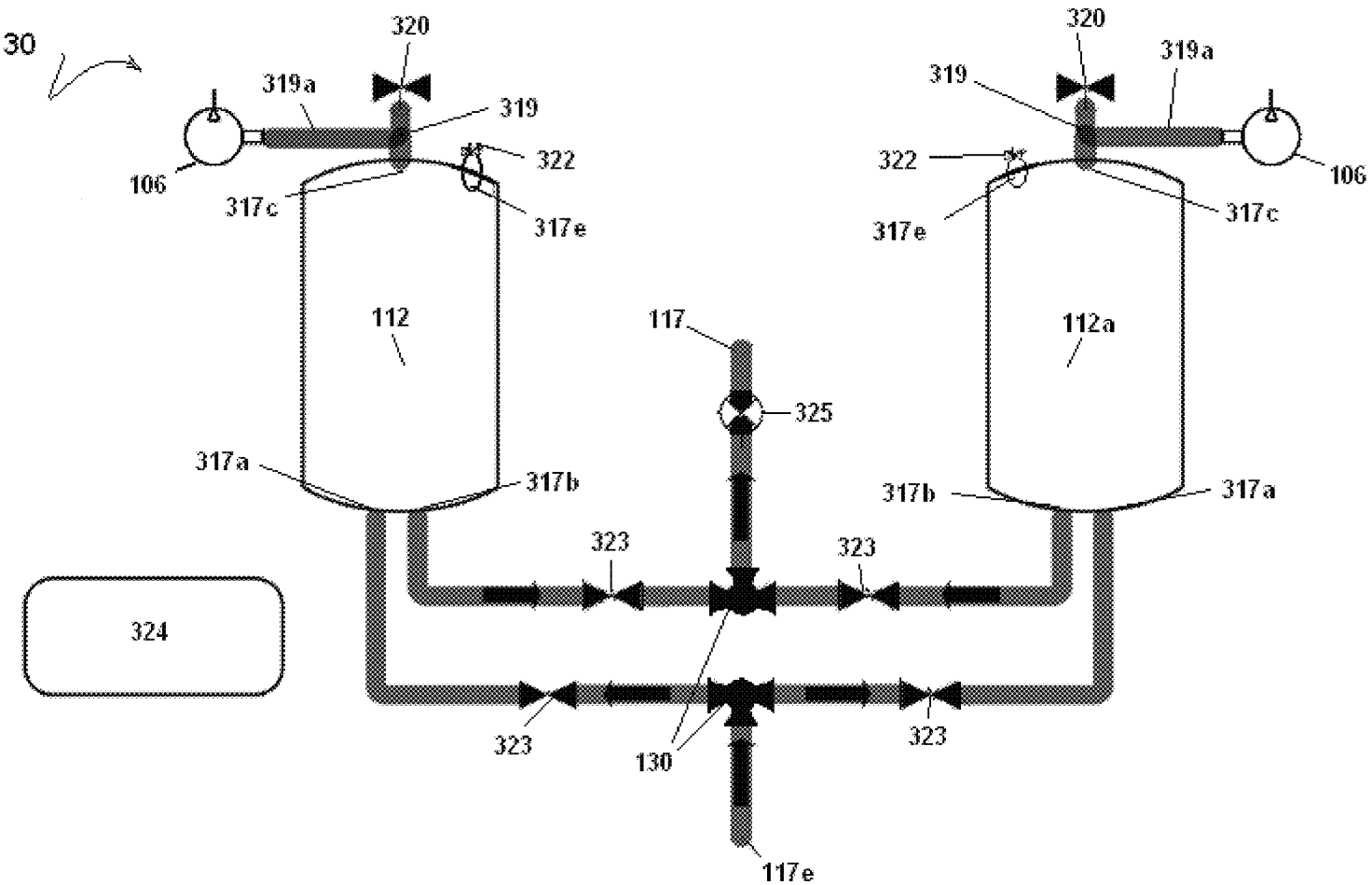
FIG. 8 shows the dual tank pressurized water delivery system interconnections in detail, where the tanks are devoid of water and the air venting valves are in closed position.
Figure 9:
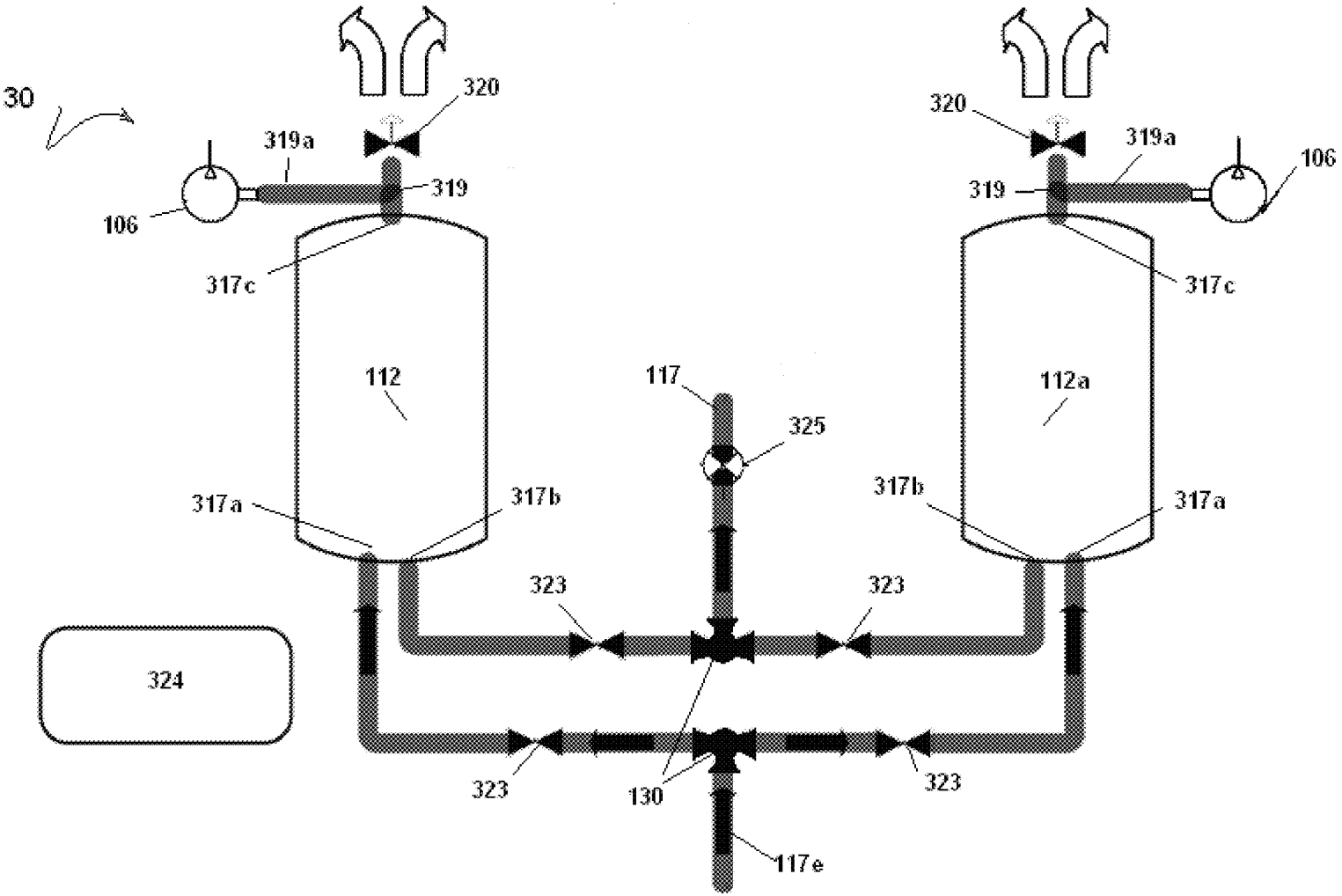
FIG. 9 shows an embodiment of the dual tank pressurized water delivery system, where both tanks contain various amount of water and air venting valves are in the opened position.
Figure 15:
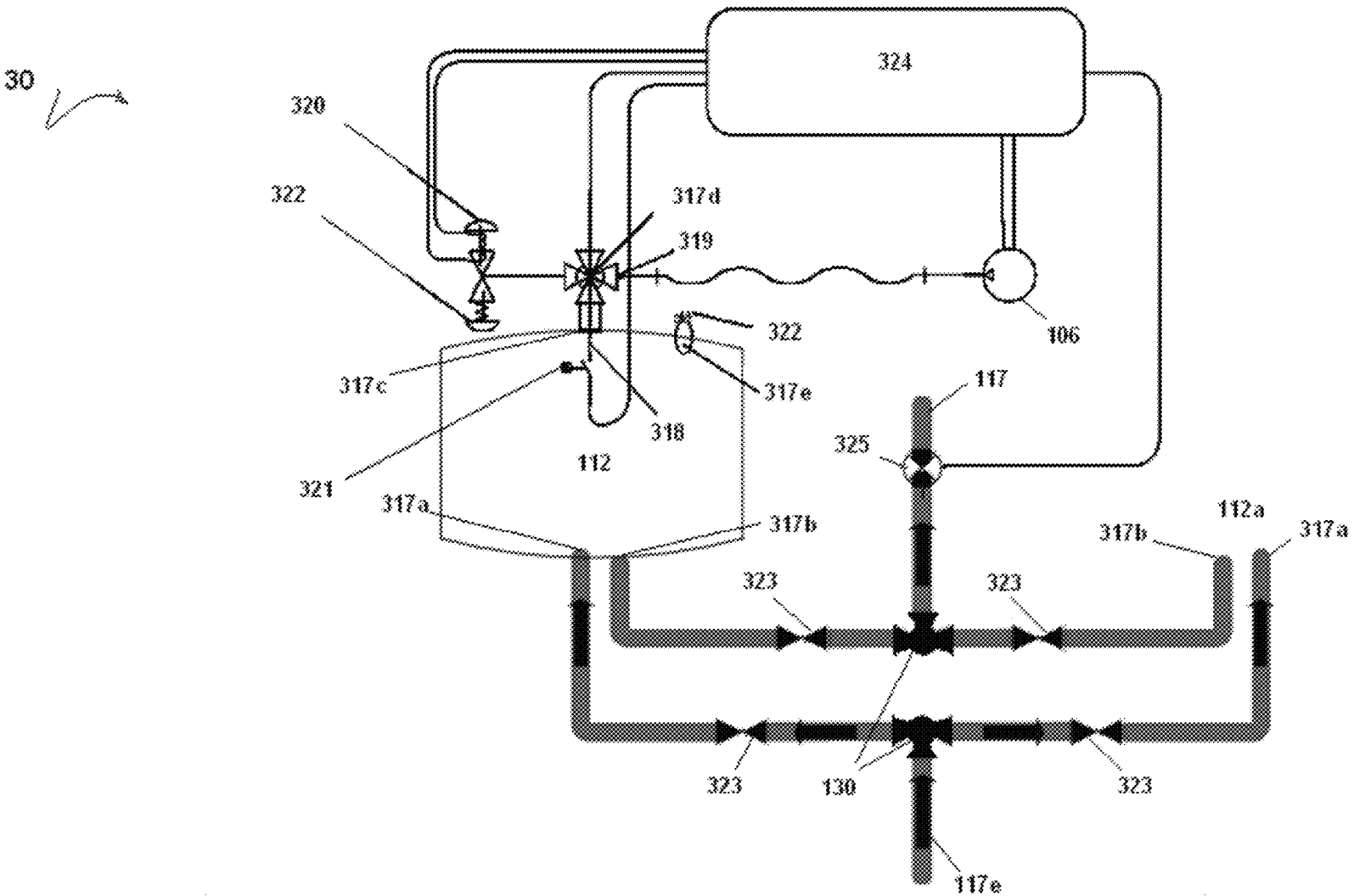
FIG. 15 shows an embodiment of the dual tank pressurized water delivery system illustrating the multifunction connector components of a third aperture in detail.

FIG. 8 shows the components and interconnections of the dual tank system 30. Referring to FIG. 8, water inlet 317*a* and outlet 317*b* apertures are located at the bottom of the tanks 112, 112*a* while a third aperture 317*c* is located at the top. The third aperture 317*c* may contain a connector 317*d* (FIG. 15) which has multiple functions integrated together that comprise the following hardware: a water level float sensor 318 (FIG. 15) (e.g., available from APG, Inc., Logan Utah); a compressed air inlet 319 (see also, FIG. 15); an air venting valve 320 (see also, FIG. 15); and a pressure release valve 322 (see also, FIG. 15). In embodiments, a fourth aperture 317*e* may contain the pressure valve 322 separate from the multiple function connector 317*d*. The water level float sensor 318 contains an electrical switch, where its "ON/OFF" state is sensed by a magnetic float 321 (FIG. 15). The float 321 is set inside the water tanks 112, 112*a*, which may be suspended from a surface therein proximal to the top of the water tanks 112, 112*a* or attached to a surface proximal to the top of the water tanks 112, 112*a* (FIG. 15). As water rises to the top of the tanks 112, 112*a*, the float 321 is pushed upwards to close the switch (FIG. 15). This switch signal is sent to the control module 324 which is in electrical, mechanical, electro-mechanical, or telemetric communication with the switch for processing by the controller module 324 (FIG. 15). One water level sensor 318 is dedicated for each tank 112, 112*a* to indicate tank 112, 112*a* water level. The controller module 324 may comprise an electronic printed circuit board (PCB), power supply regulator, solar charger, and an array of input/output interfaces that allow for electrical communication, mechanical communication, electro-mechanical communication, telemetric communication, or combinations thereof, between the controller module 324 and various components of the system 30.

The compressed air inlet 319 is an input aperture that enables a flexible lumen-containing conduit 319*a* to connect directly to an air compressor 106. This connection allows the compressor 106 to build up pressure inside the tanks 112, 112*a*. This build up of pressure inside the tanks 112, 112*a* is the driving force that raises the water pressure as water exits the outlet aperture 317*b* at the bottom of the tanks 112, 112*a*.

The air venting valve 320 may be an electrical latching solenoid valve (e.g., available from Solenoid Solutions, Inc., Erie, Pa.) which may be used as an air venting device. Typically, valves consume power to stay open or to close. However, this type of valve 320 has a magnetic latching plunger. The latching function enables the valve to stay opened or closed while consuming little power. The plunger stays open or closes depending on the polarities of a controlling pulse which drives the valve with short bursts of energy, hence it consumes very little power.

The pressure relief valve 322 functions in the event of over pressurizing the tanks 112, 112*a*, where the relief valve 322 discharges excess pressure and prevents the tanks 112, 112*a* and other components from being damaged.

The dual tank system 30 may contain at least four check valves 323 to control the direction of water flow. In embodiments, the check valves 323 are passive, spring loaded shutters; as such, they do not consume any battery power or require any controlling signals. In operation, they function to allow water to flow in only one direction.

In embodiments, air compressors 106 are high volume, high pressure units. In a related aspect, each compressor 106 connects directly to the third aperture 317*c* at the top of the tanks 112, 112*a*. One or more pressure sensors 325 may be placed after the union (e.g., by T-fitting connector 130) of the two water tank outlet conduits 117. The one or more sensors 325 are electrical switches that have two set trigger points. The "Cut-In" is set at about 25 psi, while the "Cut-Out" is set at about 45 psi. Sensor signals are sent to the control module 324, which is in electrical, mechanical, electro-mechanical, or telemetric communication with said one or more sensors 325, for processing. In the event of a wild fire, an operator may simply activate a single control switch 123*a*, 123*b*, 123*c* to start the system, which control switch 123*a*, 123*b*, 123*c* may be within the roof-containing structure 123, outside of the roof-containing structure 123, or may be activated by remote (telemetric) commands (FIG. 7).

Referring to FIGS. 8-14, the tanks 112, 112*a* may be kept empty (FIG. 8) to ensure that sludge does not build up inside the tanks 112, 112*a*; the operation sequence begins with the process of filing up the tanks 112, 112*a*. Initially, the municipal water pressure is at "normal" or "operating" pressure (e.g., approximately 50 to 60 psi). This pressure range easily overcomes the check valves 323, and water may begin to enter the tanks 112, 112*a* at the bottom through the inlet apertures

317*a*. The air venting valves 320 are in the open position (FIG. 9) to allow air inside the tank 112, 112*a* to be pushed out as the water level begins to rise. When the water level reaches the top of the tanks 112, 112*a* (FIG. 10), the water level sensor 318 is triggered, signaling the controller module 324 to close the venting valves 320. As the venting valves 320 close, a small air pocket inside each tank 112, 112*a* is formed. Because the incoming water continues to enter the tank 112, 112*a* at a high pressure force, and there is no other place for the water to go, the tanks 112, 112*a* begin to build up pressure. The built up pressure eventually forces the water to exit the outlets 317*b* at the bottom of the tanks 112, 112*a*. This represents the "fill" cycle.

Figure 10:
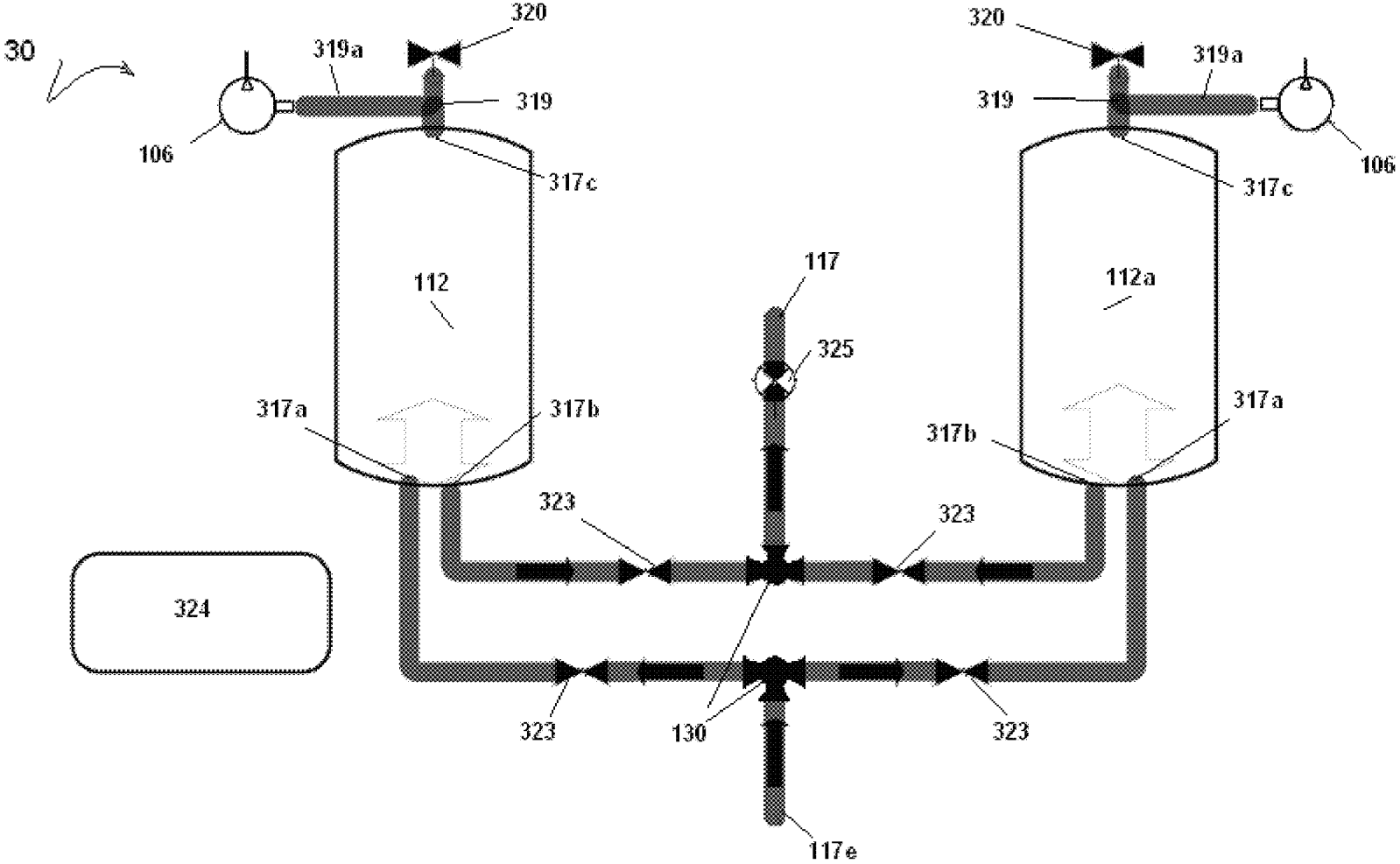
FIG. 10 shows an embodiment of the dual tank pressurized water delivery system, where both tanks (A and B) are filled with water, air venting valves are in the closed position and water may be sent from the tanks to a common outlet for delivery to misters at a pressure defined by the water inlet pressure.
Figure 11:
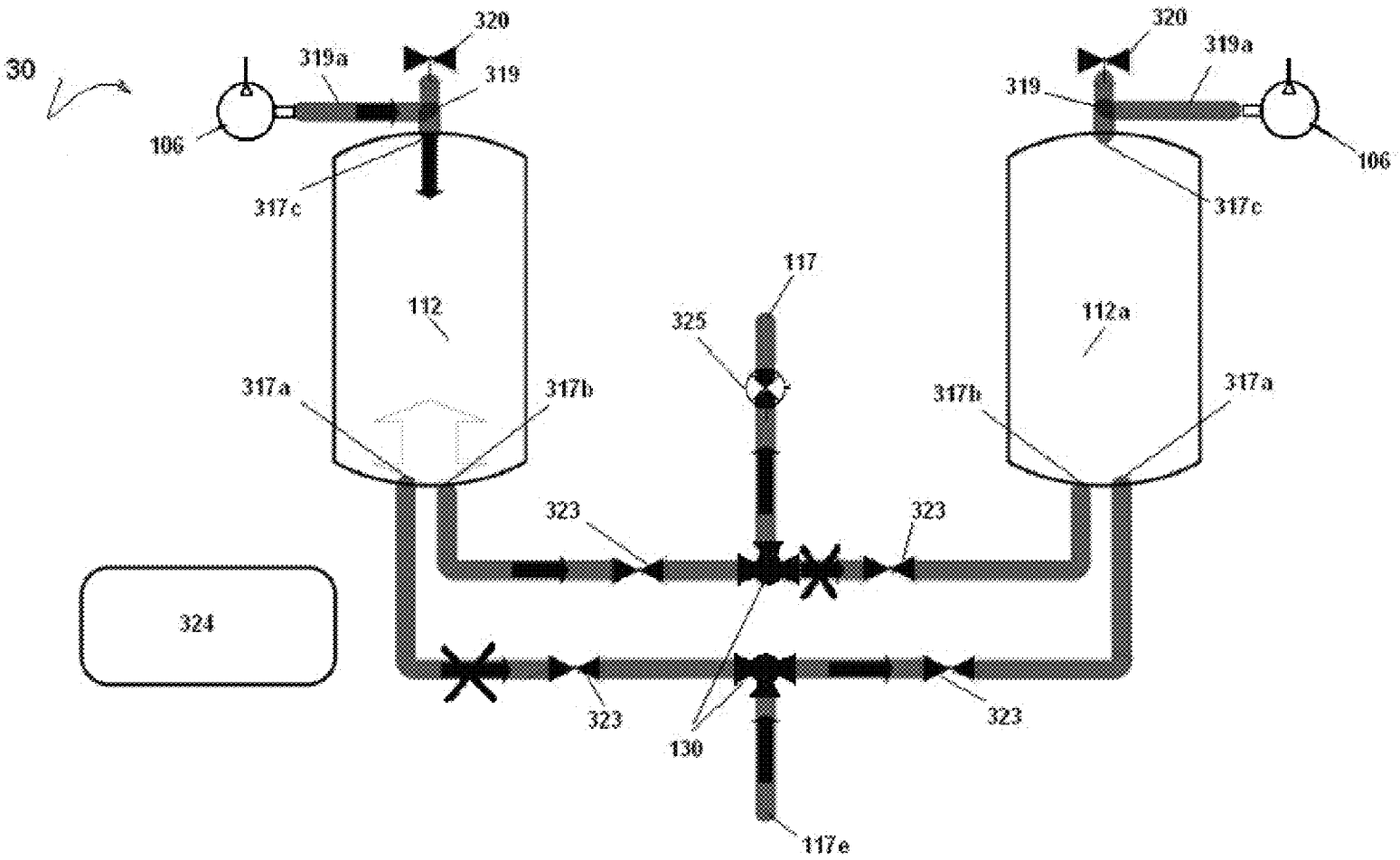
FIG. 11 shows an embodiment of the dual tank pressurized water delivery system, where the defined pressure has changed at the water inlet and a compressor is activated to increase the pressure in Tank A (air vent closed) such that pressure required for misting is maintained despite inlet pressure drop.

The pressure from the water exiting the tanks 112, 112*a* overcomes the check valves 323, where the outlet water conduits 117 may come together at a T-fitting connector 130. The pressure sensor 325 after the T-fitting connector 130, monitors the water pressure as the water moves toward the misting heads 111. This is the critical sensing point of the feedback loop. Under the initial conditions, the incoming water pressure from the source 119, 330 and the outgoing water pressure to the misting heads 111 are equal as illustrated in FIG. 10. The misting process begins at about 15 psi and gradually increases its circular misting pattern as pressure increases to about 50 psi. At this point, the system 30 is in "pass thru" mode, and no external power is being consumed. The pressure sensor 325 has at least 2 set points to signal the controller 324 its status. The "Cut-In" is at about 25 psi, and the "Cut-Out" is at about 45 psi. The set point for "low pressure" may be in the range of 0 to less than about 25 psi, where the set point for "high pressure" may be greater but not less than about 25 psi. In embodiments, as long as the water pressure is in the "high pressure" range, misting should be at optimal performance.

During an emergency event, pressure from a municipal source 119 may drop below 25 psi and affect the misting pattern severely. This condition is sensed by the pressure sensor 325 (FIG. 11) and signaled to the controller module 324 to turn "ON" Tank A 112 air compressor 106. By having the pressure build up in Tank A 112, water exits Tank A 112 and makes its way to the T-fitting connector 130. The water path is forced to this junction because there is a check valve 323 from Tank B 112*a* prohibiting water from entering Tank B 112*a*. Water pressure begins to rise and this rise in pressure restores optimal misting pressure. When water pressure has reached its "high pressure" set point, the controller module 324 turns "OFF" the compressor 106 to reserve its battery life (when battery powered). Again, the "high pressure" path is controlled by check valves 323 (no to low power consumption), where water is routed to the misting devices 111.

Figure 12:
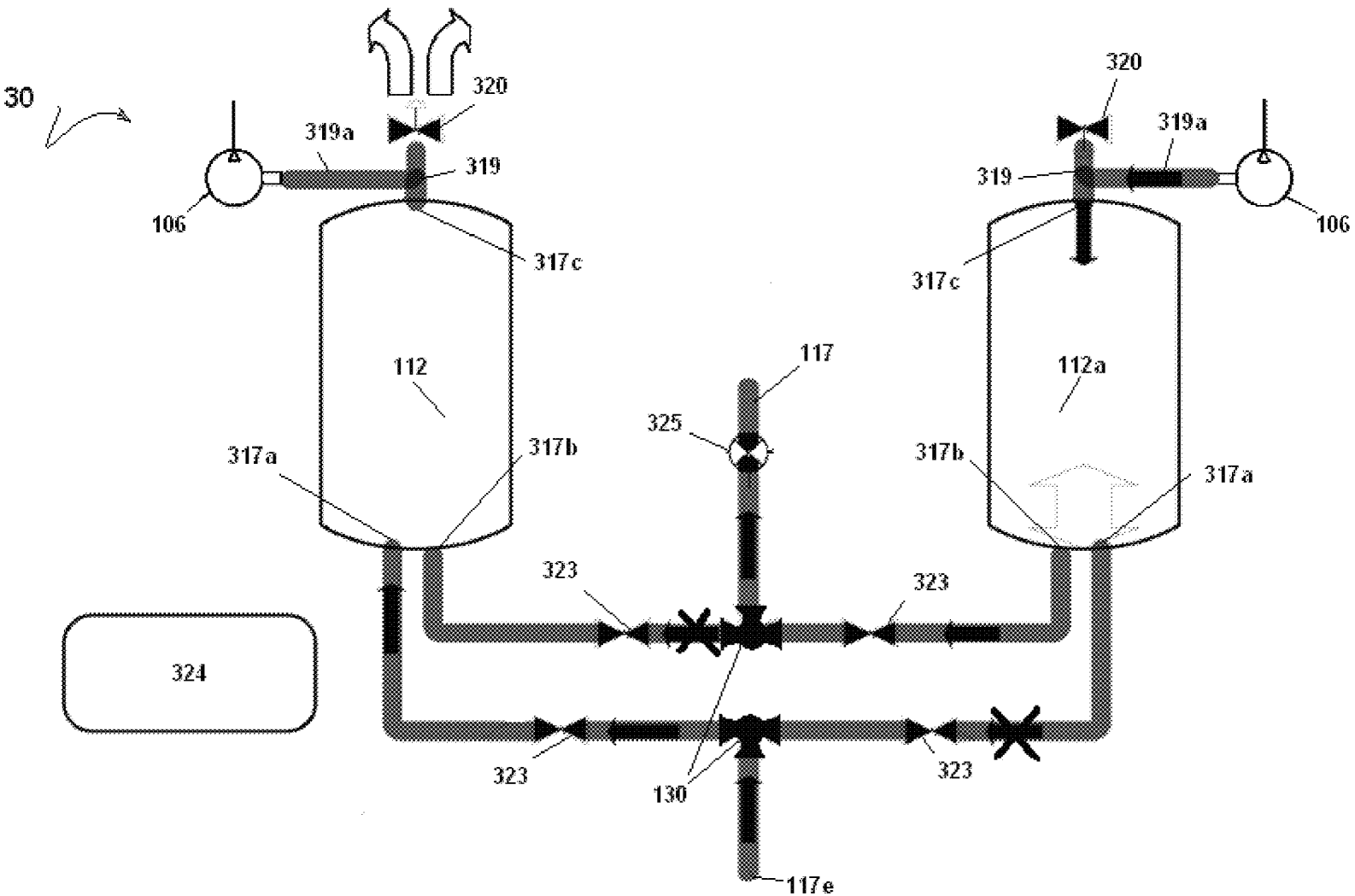
FIG. 12 shows an embodiment of the dual tank pressurized water delivery system, where after a select period of time a previously activated compressor in Tank A is turned off and the air vent opened such that Tank A may be refilled with water, concurrently the air compressor in Tank B is activated to increase the pressure in Tank B (air vent closed) such that pressure required for misting is maintained despite inlet pressure drop.
Figure 13:
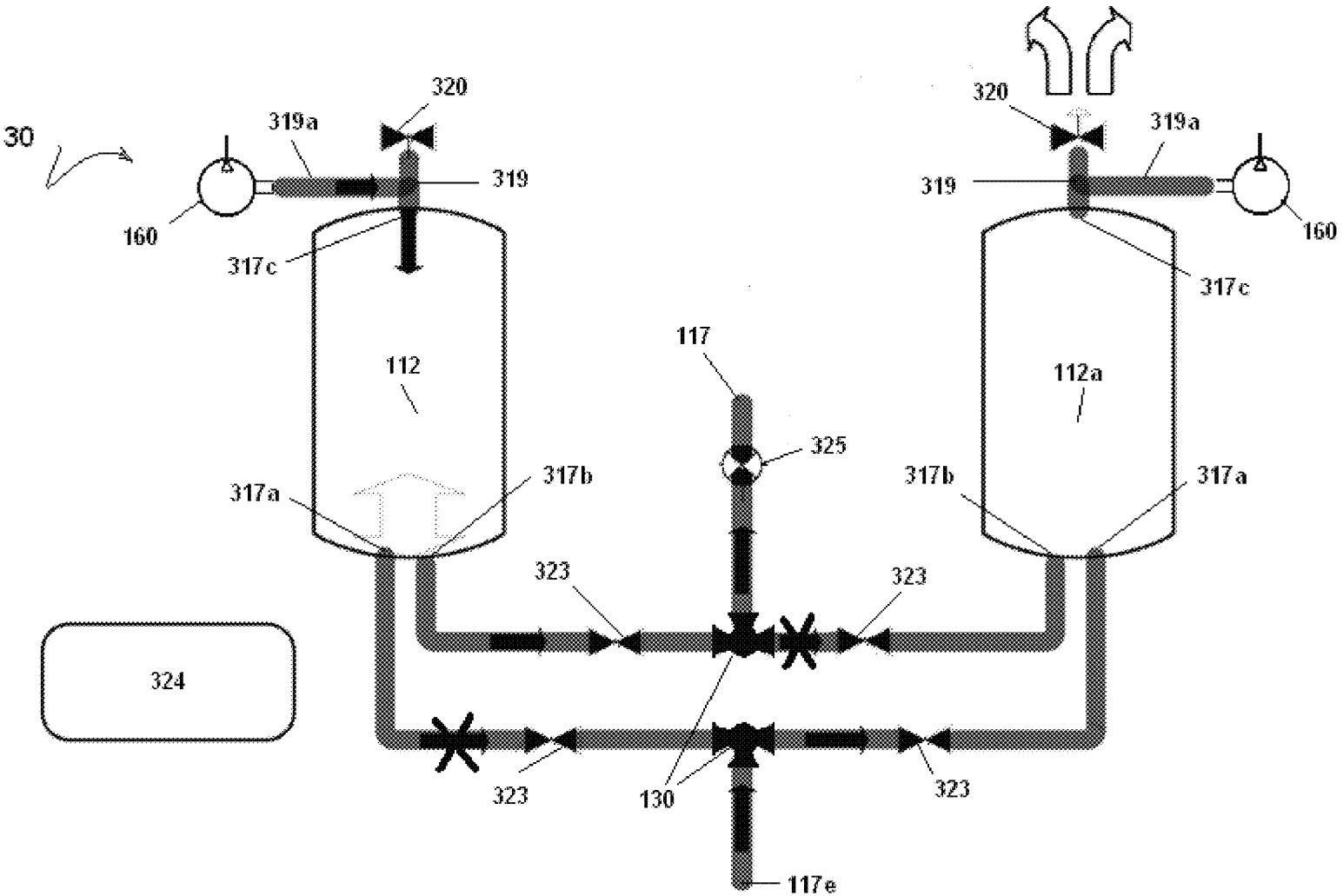
FIG. 13 shows an embodiment of the dual tank pressurized water delivery system, where after a select period of time, a previously activated compressor in Tank B is turned off and the air vent opened such that Tank B may be refilled with water, concurrently the air compressor in Tank A is activated to increase the pressure in Tank A (air vent closed) such that pressure required for misting is maintained despite inlet pressure drop.

Referring to FIG. 12, after Tank A 112 discharges for a set period of time (between about 10 and 15 minutes or about 12 minutes), the controller module 324 switches the discharge cycle to Tank B 112*a*. The switching comprises multiple operations. The controller module 324, in mechanical, electrical, electro-mechanical, or telemetric communication with the air venting valve 320 for Tank A, opens the air venting valve 320 allowing compressed air to escape, so that "low pressure" water can refill the tank 112. Simultaneously, the controller module 324, in mechanical, electrical, electro-mechanical, or telemetric communication with the air venting valve 320 of Tank B 112*a*, closes the air venting valve 320 for Tank B 112*a* (in embodiments, this valve 320 may already be in a closed state), and turns "ON" the air compressor 106 for Tank B 112*a*. The operation affords a smooth transition between tanks 112, 112*a*, and allows continuous discharging of pressurized water, while at the same time filling up a partially discharged tank (112 or 112*a*). The alternating of discharge and refill of the water tanks 112, 112*a* continues until "normal" or "operating" water pressure is restored (see FIG. 13).

Figure 14:
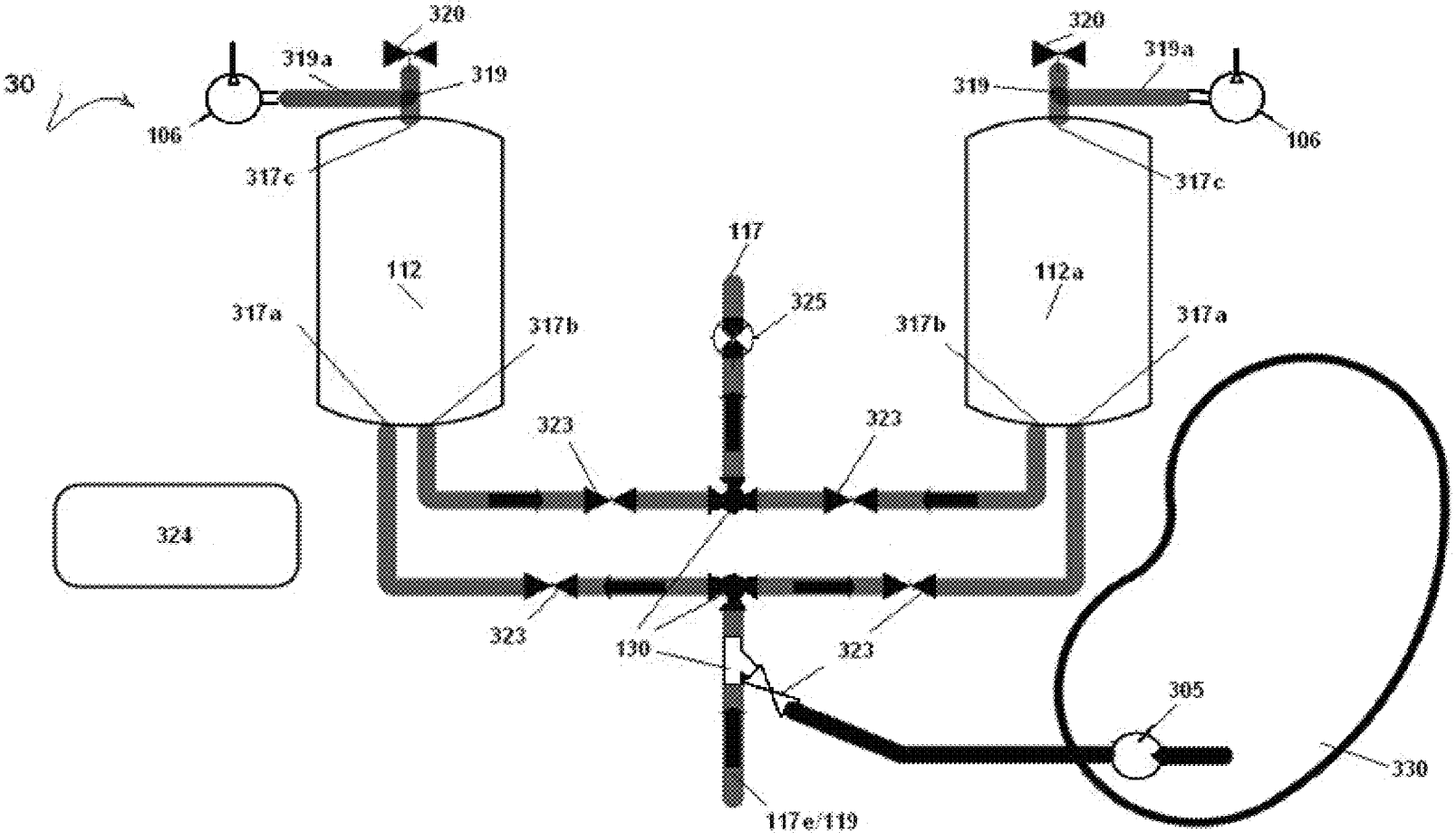
FIG. 14 shows an embodiment of the dual tank pressurized water delivery system with an alternate water source supplied by a swimming pool or other body of water external to public water supply, where a submerged pump in the alternative water source delivers water to the system.

The dual tank system 30 is a self-pressurizing water system that is taking water and raising its pressure to the point where it may be misted by downstream components of the system 30 when municipal water supply 119 pressure drops. Because of this function, the system is flexible and may easily be expanded to tap into other water sources 330, including but not limited to, swimming pools, ponds, streams, lakes, rivers, tributaries, fountains, wells, reservoirs, oceans, seas, and the like, to further supplement the duration of the water supply. These water sources may have no pressure (or are at ambient pressure), but with the addition of a submerged water pump 305 and check valve 223, the system now has access to such external water supplies 330 (FIG. 14). The submerged pump 305 may also be in mechanical, electrical, electro-mechanical, or telemetric communication with the controller module 324. As the fill rate from the municipal water source 119 slows down due to reduced water pressure, the submerged pump 305 turns "ON", and increases the water filling rate of the system 30 by tapping into the external water supply 330. This configuration of the use of an external water supply is designed to save power such that the pump 305 is only turned "ON" as necessary.

When there is a need for operators to turn "ON" the system 30 while away from the roof-containing structure 123, the system 30 may utilize a home Wi-Fi network, Bluetooth technology or a Telephone Landline Reverse 911 Emergency Service to turn the system 30 "ON". This process may be fully automated and accessible via Smartphone or PC application. For operators that enroll in security services, this remote triggering function may be offered by the service provider to expand and include a wild fire protection service.

Although the invention has been described with reference to the above embodiments, it will be understood that modifications and variations are encompassed within the spirit and scope of the invention.

All references cited herein are herein incorporated by reference in their entirety.

I claim herein:

1. A system for protecting a roof-containing structure from fire embers comprising:

a) at least two fluid containers each comprising a first, second, third and fourth aperture, and a water level float sensor suspended from a surface within each said at least two fluid containers, which fourth aperture is coupled to a pressure relief valve, and which second aperture is connected to a first lumen-containing conveyance configured to be in one-way fluid communication with a water supply separate from said at least two fluid containers via a check valve;

b) a first device connected to each fluid container through the third aperture that discontinuously increases the pressure of a gas above a fluid in said at least two fluid containers by providing air flow into said at least two fluid containers, wherein the first device is connected to said third aperture via a second lumen-containing conveyance connected to a multiple function connector, which multiple function connector is connected to an air venting valve;

c) at least one third lumen-containing conveyance where one end is connected to each said at least two fluid containers at said first aperture, wherein said each at least one third lumen-containing conveyance is configured to be in one-way fluid communication with said at least two fluid containers via a check valve, which each at least one third lumen containing conveyance is connected at a second end to a T-fitting connector;

d) at least one fourth lumen-containing conveyance connected at one end to said T-fitting connector, wherein the at least one fourth lumen-containing conveyance comprises:

i) at least one pressure sensor proximal to said T-fitting connector and ii) one or more nodal points along said at least one fourth lumen containing conveyance distal to said at least two fluid containers which comprises a second device at said one or more nodal points, wherein said second device comprises one or more atomizing orifices; and e) a controller module in electro-mechanical communication with each said first device, said at least one pressure sensor, said air venting valve, and said water level float sensor, wherein said at least one fourth conveyance is releasably coupled to an outer surface of said roof-containing structure such that an atomized fluid delivered by said at least one fourth lumen-containing conveyance and buoyant fire embers co-segregate via heat convection.

2. The system of claim 1, wherein said controller module communicates with each said first device, said at least one pressure sensor, said air venting valve, and said water level float sensor wirelessly.

3. The system of claim 1, wherein the water supply is Connected to said first lumen-containing conveyance via a second T-fitting connector and a fifth lumen-containing conveyance, which said fifth lumen-containing conveyance is directly connected to at least one source of water.

4. The system of claim 3, wherein said at least one source of water is pressurized or non-pressurized.

5. The system of claim 4, further comprising a third device in fluid communication with said fifth lumen-containing conveyance that discontinuously moves water into said fifth lumen-containing conveyance, wherein said third device is submerged in a source of water which is non pressurized or is at ambient pressure.

6. The system of claim 5, wherein said source of water which is non pressurized or is at ambient pressure is selected from the group consisting of swimming pools, ponds, streams, lakes, rivers, tributaries, fountains, wells, reservoirs, oceans, seas, and combinations thereof.

7. The system of claim 4, wherein the pressurized water is from a municipal source.

8. The system of claim 1, wherein said first device is an air-compressor.

9. The system of claim 1, wherein said air venting valve is an electrical latching solenoid valve.

10. The system of claim 1, wherein said check valves comprise passive, spring loaded shutters.

11. The system of claim 5, wherein said third device is a pump.

12. The system of claim 1, wherein said at least one fourth lumen-containing conveyance is releasably coupled to said outer surface:

i) along one or more gutters at the periphery of said roof-containing, structure;

ii) at one or more vents projecting from an upper surface of said roof-containing structure;

iii) along one or more valleys of said roof-containing structure; or iv) a combination of (i), (ii), and (iii).

13. An apparatus for protecting a roof-containing structure from fire embers comprising:

a) at least two fluid containers each comprising a first, second, third and fourth aperture, and a water level float sensor suspended from a surface within each said at least two fluid containers, which fourth aperture is coupled to a pressure relief valve, and which second aperture is connected to a first lumen-containing conveyance configured to be in one-way fluid communication with a water supply separate from said at least two fluid containers via a check valve;

b) a first device connected to each fluid container through the third aperture that discontinuously increases the pressure of a gas above a fluid in said at least two containers by providing air flow into said at least two fluid containers, wherein the first device is connected to said third aperture via a second lumen-containing conveyance connected to a multiple function connector, which multiple function connector is connected to an air venting valve;

c) at least one third lumen-containing conveyance where one end is connected to each said at least two fluid containers at said first aperture, wherein said each at least one third lumen-containing conveyance is configured to be in one-way fluid communication with said at least two fluid containers via a check valve, which each at least one third lumen containing conveyance is connected at a second end to a T-fitting connector;

d) at least one fourth lumen-containing conveyance connected at one end to said T-fitting connector, wherein the at least one fourth lumen-containing conveyance comprises:

i) at least one pressure sensor proximal to said T-fitting connector and ii) one or more nodal points along said at least one fourth lumen-containing conveyance distal to said at least two fluid containers which comprises a second device at said one or more nodal points, wherein said second device comprises one or more atomizing orifices; and e) a controller module in electro-mechanical communication with each said first device, said at least one pressure sensor, said air venting valve, and said water level float sensor.

14. The apparatus of claim 13, wherein said controller module communicates with each said first device, said at least one pressure sensor, said air venting valve, and said water level float sensor wirelessly.

15. The apparatus of claim 13, wherein the water supply is connected to the first lumen-containing conveyance via a second T-fitting, connector and a fifth lumen-containing conveyance, which said fifth lumen-containing conveyance is directly connected to at least one source of water.

16. The apparatus of claim 15, wherein said least one source of water is pressurized or non-pressurized.

17. The apparatus of claim 16, further comprising a third device in fluid communication with said fifth lumen-containing conveyance that discontinuously moves water into said fifth lumen-containing conveyance, wherein said third device is submerged in a source of water which is non pressurized or is at ambient pressure.

18. A method of maintaining pressure of the system according to claim 1 comprising:

i) filling the at least two fluid containers with a liquid at a system water pressure of between about 50 to about 60 psi, wherein said air venting valve in each of said at least two fluid containers is open;

ii) closing said air venting valve in each of said at least two fluid containers when the liquid reaches the top of said at least two fluid containers via said communication between said water level float sensor and said controller module;

iii) detecting a drop in water inlet pressure via said at least one pressure sensor proximal to said T-fitting connector, wherein the first device is turned ON in one of said at least two fluid containers when said at least one pressure sensor detects a system water pressure between about 0 psi and about 25 psi via said communication between said at least one pressure sensor and said controller module;

iv) turning the first device OFF in said one of said at least two fluid containers at a first set period of time, v) turning the first device ON in another one of said at least two fluid containers after said first period of time, wherein the air venting valve for said one of said at least two fluid containers is opened via said communication between said air venting valve in said one of said at least two fluid containers and said controller module, and wherein the air venting valve of said another one of said at least two fluid containers is closed via said communication between said air venting valve in said another one of said at least two fluid containers and said controller module;

vi) turning the first device OFF in said another one of said at least two fluid containers at a second set period of time;

vii) turning the first device ON in said one of said at least two fluid containers after said second set period of time, wherein the air venting valve for said another one of said at least two fluid containers is opened via said communication between said air venting valve in said another one of said at least two fluid containers and said controller module, and wherein the air venting valve of said one of said at least two fluid containers is closed via said communication between said air venting valve in said one of said at least two fluid containers and said controller module; and viii) repeating steps (iv)-(vii) until said system water pressure reaches a pressure greater than about 25 psi.

19. The method of claim 18, wherein said system water pressure and liquid release rate are such that said liquid is released over a period from about 0.5 to 8 hours.

20. The method of claim 19, wherein the liquid is selected from the group consisting of water, water and cellulose, water and ammonia; water, camphor, and ammonium chloride; hydroxyl ammonium nitrate, an amine nitrate salt, and combinations thereof.

* * * * *